US005632306A

United States Patent [19]

Taka

[11] Patent Number: 5,632,306

[45] Date of Patent: May 27, 1997

[54] OPERATING VALVE ASSEMBLY WITH ELECTROMAGNETIC PROPORTIONING PRESSURE REDUCTION VALVE

[75] Inventor: Keisuke Taka, Kawasaki, Japan

[73] Assignee: Kabushiki Kaisha Komatsu Seisakusho, Tokyo, Japan

[21] Appl. No.: 448,377

[22] PCT Filed: Dec. 22, 1993

[86] PCT No.: PCT/JP93/01860

§ 371 Date: Jun. 7, 1995

§ 102(e) Date: Jun. 7, 1995

[87] PCT Pub. No.: WO94/15128

PCT Pub. Date: Jul. 7, 1994

[30] Foreign Application Priority Data

Dec. 22, 1992 [JP] Japan ..... 4-341979

[51] Int. Cl.[6] ..... F15B 13/043; F15B 13/08

[52] U.S. Cl. ..... 137/625.64; 137/596.16; 137/884

[58] Field of Search ..... 137/596.16, 625.64, 137/884

[56] References Cited

U.S. PATENT DOCUMENTS 3,488,953 1/1970 Haussler ..... 137/596.13 X

FOREIGN PATENT DOCUMENTS 47-10751 3/1972 Japan .
60-77870 5/1985 Japan .
60-116982 6/1985 Japan .
64-29581 2/1989 Japan .
3-30678 3/1991 Japan .

*Primary Examiner*—Gerald A. Michalsky
*Attorney, Agent, or Firm*—Frishauf, Holtz, Goodman, Langer & Chick

[57] ABSTRACT

An operating valve assembly with an electromagnetic proportioning pressure reduction valve comprises an operating valve constructed by slidably disposing a spool in a spool bore opening to an end face of a valve body, mounting a spring case including a case body having a blind bore and a housing having a spool bore for a pressure reduction valve on the end face in a manner such that the spool bore and the blind bore are matched to each other, and defining a pressure receiving chamber between the interior wall of the blind bore of the spring case and the end portion of the spool, and the electromagnetic proportioning pressure reduction valve constructed by disposing a spool for the pressure reduction valve in the spool bore for the pressure reduction valve, and mounting a solenoid for driving the spool for the pressure reduction valve on the housing, and an output port of the electromagnetic proportioning pressure reduction valve is communicated with the pressure receiving chamber.

15 Claims, 7 Drawing Sheets

PRIOR ART

OPERATING VALVE ASSEMBLY WITH ELECTROMAGNETIC PROPORTIONING PRESSURE REDUCTION VALVE

FIELD OF THE INVENTION

The present invention relates to an operating valve assembly having an electromagnetic proportioning pressure reduction valve for operating a spool.

BACKGROUND ART

As an operating valve assembly, there is a known one, in which a spool is slidably disposed in a spool bore provided in a valve body and switching flow of a pressurized fluid by shifting the spool, and in order to shift the spool, pressure receiving chambers are defined at left and right ends of the spool for driving the spool by supplying a pilot pressurized fluid.

The spool shifting type operating valve assembly is troublesome in assembling for necessity of connection of an electromagnetic proportioning pressure reduction valve for outputting the pilot pressurized fluid and the operating valve by a piping. Therefore, in place of the above-mentioned type of the operating valve assembly, there has been proposed an operating valve assembly, in which the electromagnetic proportioning pressure reduction valve is provided in a valve body.

In Japanese Unexamined Utility Model Publication (Kokai) No. Heisei 3-30678, there is disclosed an operating valve assembly, in which a pressure reduction valve receptacle bore 3 is formed in a valve body 2 having the spool bore with a spool 1 slidingly disposed therein, a pressure reduction valve 4 is slidingly disposed in the pressure reduction valve receptacle bore 3, and a solenoid 5 for driving the pressure reduction valve 4 is provided at the end face of the valve body to form the electromagnetic proportioning pressure reduction valve 6. It should be noted that the reference numeral 8 denote pressure receiving chambers at left and right end sides of the spool 1, as shown in FIG. 1.

On the other hand, Japanese Unexamined Utility Model Publication No. Heisei 1-29581, there is disclosed an operating valve assembly, in which the pressure reduction valve 4 is slidably disposed in a main body 7, and the solenoid 5 for driving the pressure reduction valve 4 is mounted on the main body 7 to form the electromagnetic proportioning pressure reduction valve 6, and the main body 7 is mounted at a spring chamber side of the valve body 2, as shown in FIG. 2.

However, in the case of the former operating valve assembly, it becomes necessary to form a fluid conduit 9 in the valve body 2 for communicating the pressure reduction valve receptacle bore 3, an inlet port 3*a* for pilot pressure, a tank port 3*b* and the pressure receiving chambers 8 with the output side. Therefore, the structure of the valve body 2 becomes specific for the operating valve assembly with the electromagnetic proportioning pressure reduction valve. Thus, the valve body 2 cannot be common to the main body for the typical ordinary operating valve assembly.

On the other hand, in the case of later operating valve assembly, since two electromagnetic proportioning pressure reduction valves 6 are mounted at one side of the valve body 2, a plane view configuration of the overall operating valve assembly (configuration in a plane perpendicular to the axial center of the spool 1) becomes large. Thus, a spatial difficulty is encountered in installation of an auxiliary valve. On the other hand, when the auxiliary valve is installed, the plane configuration becomes very large to require large installation area.

Therefore, it is an object of the present invention to provide an operating valve assembly with an electromagnetic proportioning pressure reduction valve which does not require to provide an output circuit of the electromagnetic proportioning pressure reduction valve in a valve body, permits the valve body to be common to the valve body of the ordinary operating valve assembly, thus can form the operating valve assembly with the electromagnetic proportioning pressure reduction valve with one valve body, can be the ordinary operating valve assembly, can be compact in plane configuration to facilitate installation of an auxiliary valve, and can be installed in a small area even when the auxiliary valve is mounted.

DISCLOSURE OF THE INVENTION

An operating valve assembly with an electromagnetic proportioning pressure reduction valve according to the present invention has been worked out in view of the foregoing fact. In order to accomplish the above-mentioned and other objects, there is provided an operating valve assembly with an electromagnetic proportioning pressure reduction valve, according to one aspect of the invention, comprising:

an operating valve constructed by slidably disposing a spool in a spool bore opening to an end face of a valve body, mounting a spring case including a case body having a blind bore and a housing having a spool bore for a pressure reduction valve on the end face in a manner such that the spool bore and the blind bore are matched to each other, and defining a pressure receiving chamber between the interior wall of the blind bore of the spring case and the end portion of the spool; and an electromagnetic proportioning pressure reduction valve constructed by disposing a spool for the pressure reduction valve in the spool bore for the pressure reduction valve, and mounting a solenoid for driving the spool for the pressure reduction valve on the housing; and an output port of the electromagnetic proportioning pressure reduction valve is communicated with the pressure receiving chamber.

With the construction set forth above, since the electromagnetic proportioning pressure reduction valve is constructed by mounting the spool for the pressure reduction valve and the solenoid on the spring case, and the operating valve with the electromagnetic proportioning pressure reduction valve can be constructed by mounting the spring case to the end face of the valve body, it becomes unnecessary to provide an output circuit of the electromagnetic proportioning pressure reduction valve and thus the valve body can be made common to the valve body of the ordinary operating valve. Accordingly, by employing a valve body of this kind, the operating valve with the electromagnetic proportioning pressure reduction valve and the ordinary operating valve can be selectively formed.

On the other hand, since the electromagnetic proportioning pressure reduction valve is mounted on the end face of the valve body, the plane configuration can be made compact and installation of an auxiliary valve can be facilitated. Also, even when the auxiliary valve is mounted, it can be installed in a small place.

In the operating valve assembly with an electromagnetic proportioning pressure reduction valve as set forth above, it is preferable that a pair of left and right pressure receiving chambers are defined by mounting the spring cases on left and right end faces of the valve body and the solenoids are mounted on respective spring cases for forming a pair of left and right electromagnetic proportioning pressure reduction valves, and each of the output ports of the electromagnetic proportioning pressure reduction valves is communicated with each of the pressure receiving chambers.

Also, it is preferred that a pump port for the pressure reduction valve and a tank port for the pressure reduction valve are formed opening to the front and back side end faces of the valve body, the pump port for the pressure reduction valve being communicated with an inlet port of the housing, and the tank port for the pressure reduction valve being opened to the spool bore for the pressure reduction valve of the housing.

It is also preferred that a pump port for the pressure reduction valve and a tank port for the pressure reduction valve are formed opening to the lateral side end faces of the valve body, the pump port for the pressure reduction valve being communicated with an inlet port of the housing, and the tank port for the pressure reduction valve being opened to the spool bore for the pressure reduction valve of the housing.

It is further preferred that a pump port for the pressure reduction valve and a tank port for the pressure reduction valve are formed opening to the lateral side end faces and front and back side end faces of the valve body, respectively, the pump port for the pressure reduction valve being communicated with an inlet port of the housing, and the tank port for the pressure reduction valve being opened to the spool bore for the pressure reduction valve of the housing.

According to another aspect of the invention, there is provided a multiple valve assembly constructed by forming an operating valve assembly with an electromagnetic proportioning pressure reduction valve comprising:

an operating valve constructed by slidably disposing a spool in a spool bore opening to an end face of a valve body, mounting a spring case including a case body having a blind bore and a housing having a spool bore for a pressure reduction valve on the end face in a manner such that the spool bore and the blind bore are matched to each other, and defining a pressure receiving chamber between the interior wall of the blind bore of the spring case and the end portion of the spool; and an electromagnetic proportioning pressure reduction valve constructed by disposing a spool for the pressure reduction valve in the spool bore for the pressure reduction valve, and mounting a solenoid for driving the spool for the pressure reduction valve on the housing; and an output port of the electromagnetic proportioning pressure reduction valve is communicated with the pressure receiving chamber; and coupling a plurality of the operating valve assemblies with electromagnetic proportioning pressure reduction valves.

It is preferred in the multiple valve assembly constructed set forth above that a pump port for the pressure reduction valve and a tank port for the pressure reduction valve are formed opening to the front and back side end faces of said valve body, said pump port for the pressure reduction valve being communicated with an inlet port of the housing, and the tank port for the pressure reduction valve being opened to the spool bore for the pressure reduction valve of the housing, respective pump ports for the pressure reduction valves and tank ports for the pressure reduction valves of a plurality of operating valve assemblies with an electromagnetic proportioning pressure reduction valves and a plurality of the operating valve assemblies are communicated with each other, a block having an inlet port for the pressure reduction valve and an outlet port for the pressure reduction valve communicating with one of pump ports for the pressure reduction valves and one of the tank ports for the pressure reduction valves of a plurality of the operating valve assemblies with electromagnetic proportioning pressure reduction valves, respectively.

Also, according to a further aspect of the invention, there is provided a multiple valve assembly constructed by forming an operating valve assembly with an electromagnetic proportioning pressure reduction valve comprising:

an operating valve constructed by slidably disposing a spool in a spool bore opening to an end face of a valve body, mounting a spring case including a case body having a blind bore and a housing having a spool bore for a pressure reduction valve on the end face in a manner such that the spool bore and the blind bore are matched to each other, and defining a pressure receiving chamber between the interior wall of the blind bore of the spring case and the end portion of the spool; and an electromagnetic proportioning pressure reduction valve constructed by disposing a spool for the pressure reduction valve in the spool bore for the pressure reduction valve, and mounting a solenoid for driving the spool for the pressure reduction valve on the housing; and an output port of the electromagnetic proportioning pressure reduction valve is communicated with the pressure receiving chamber;

forming an operating valve assemblies by slidingly disposing a spool in a spool bore opening to an end face of a valve body, mounting a spring case including a case body having a blind bore and a housing having a spool bore for a pressure reduction valve on the end face in a manner such that the spool bore and the blind bore are matched to each other, and defining a pressure receiving chamber between the interior wall of the blind bore of the spring case and the end portion of the spool; and coupling a plurality of the operating valve assemblies with electromagnetic proportioning pressure reduction valves and a plurality of the operating valve assemblies.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

Preferred embodiment of an operating valve assembly with an electromagnetic proportioning pressure reduction valve according to the present invention will be discussed hereinafter with reference to FIGS. 3 to 5.

Figure 1:
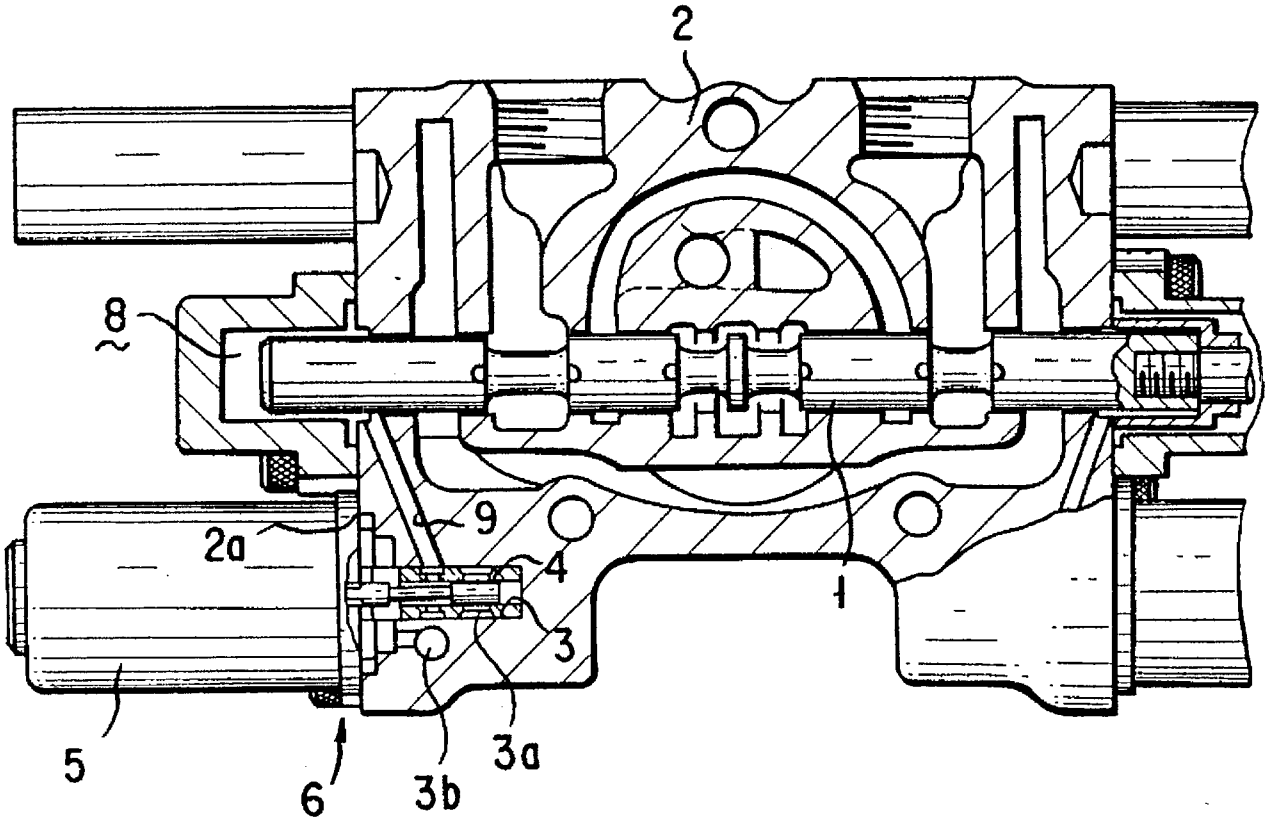
FIG. 1 PRIOR ART
FIG. 1 is a section of the conventional operating valve assembly with an electromagnetic proportioning pressure reduction valve.
Figure 2:
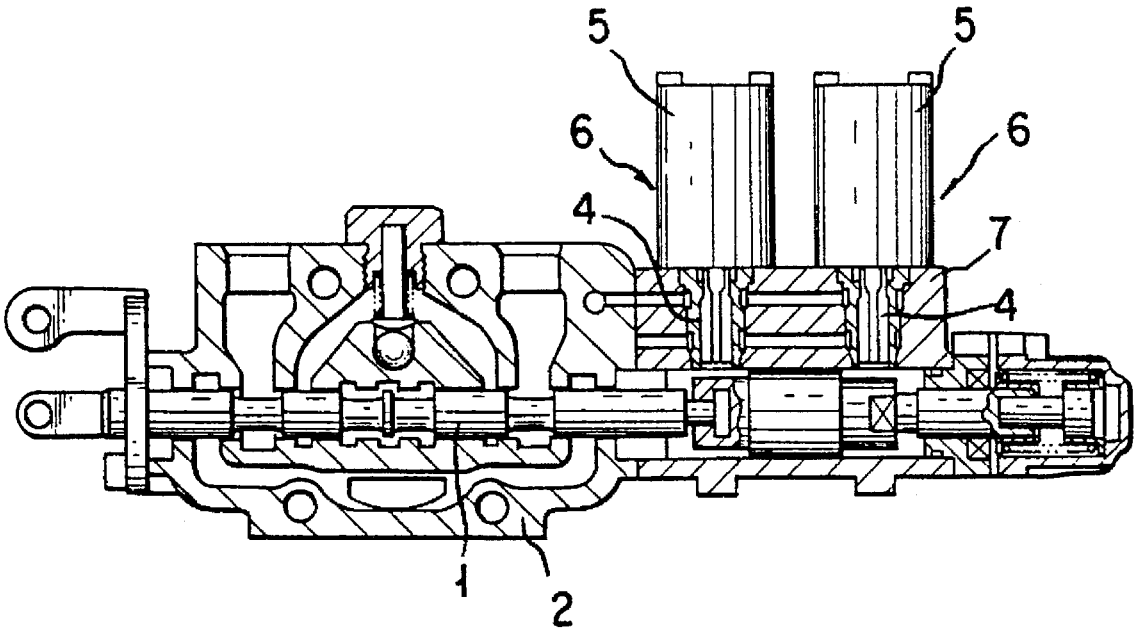
FIG. 2 is a section of another conventional operating valve assembly with an electromagnetic proportioning pressure reduction valve.
Figure 3:
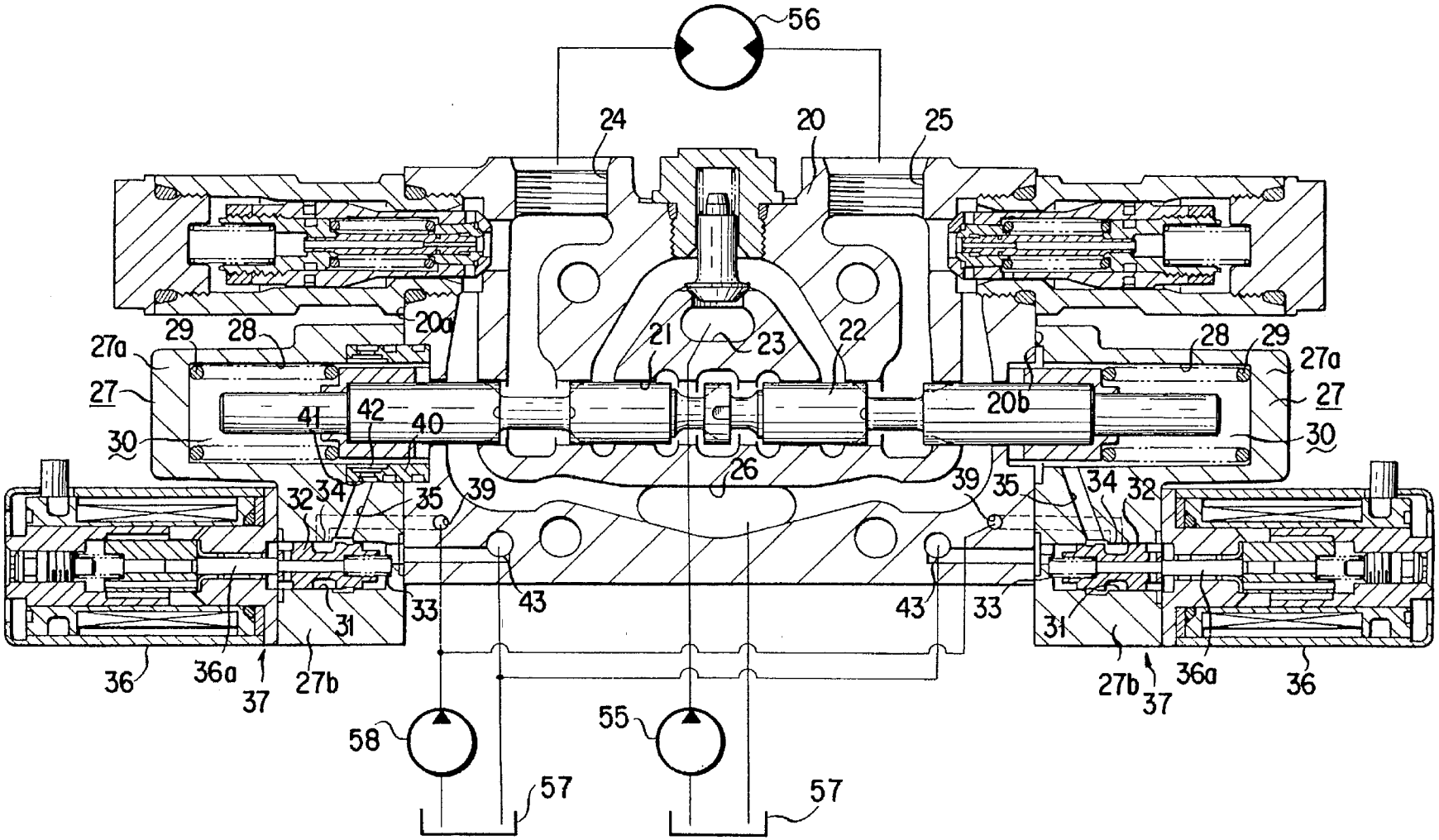
FIG. 3 is a longitudinal section of one embodiment of an operating valve assembly with an electromagnetic proportioning pressure reduction valve according to the present invention.
Figure 4:
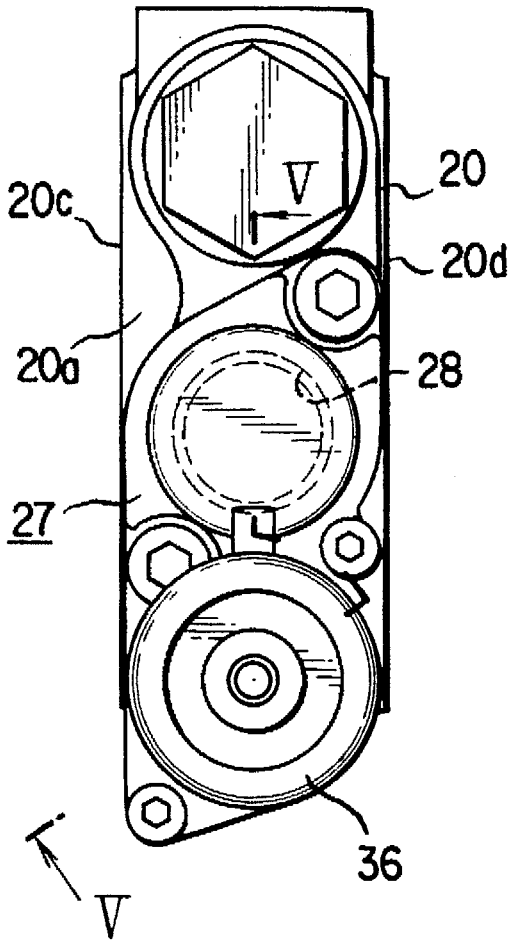
FIG. 4 is a left side section of FIG. 3.
Figure 5:
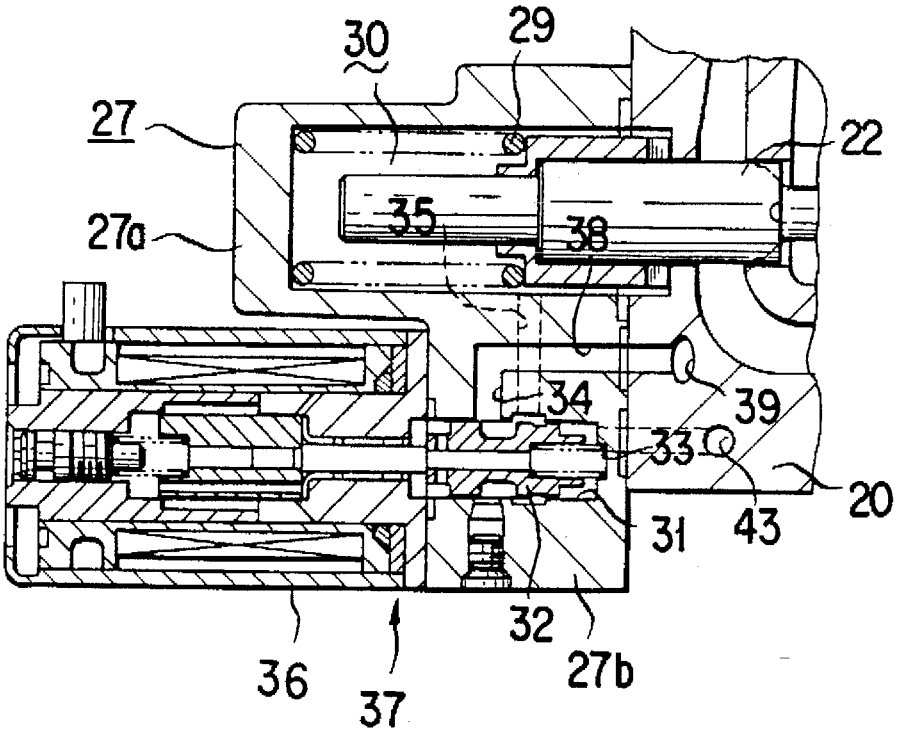
FIG. 5 is a section taken along line V—V of FIG. 4.

As shown in FIGS. 3 and 4, a valve body 20 is formed with a spool bore 21 opening at left and right end faces 20*a* and 20*b*. A spool 22 is slidably disposed in a spool bore 21. By shifting the spool 22 toward left and right, a pressurized fluid introduced from a pump 55 via a pump port 23 is flown out to one of first and second actuator ports 24 and 25 and supplied to an actuator 56. Also, a return fluid from the actuator 56 flowing into the other of the second and first actuator ports 25 and 24 is flown out to a tank 57 via a tank port 26.

On the left and right end faces 20*a* and 20*b* of the valve body 20, spring cases 27 are mounted. Each of the spring cases 27 is integrally formed with a case body 27*a* having a blind bore 28 and a pressure reduction valve housing 27*b*. The end portion of the spool 22 is projected into the blind bore 28. The spool 22 is held at the neutral position by means of a spring 29. A pressure receiving chamber 30 is defined between the blind bore 28 and the end of the spool 22.

In the housing 27*b* of the spring case 27, a pressure reduction valve receptacle bore 31 is formed. A spool 32 for a pressure reduction valve is disposed in the pressure reduction valve receptacle bore 31. As shown in FIGS. 3 and 5, the spool 32 for the pressure reduction valve is biased in a direction for closing the inlet port 34 and the outlet port 35 by a spring 33, and pushed in a direction of opening by a push rod 36*a* of a solenoid 36 mounted on the end face of the housing 27*b*. Thus, an electromagnetic proportioning pressure reduction valve 37 is constructed.

As shown in FIG. 3, the inlet port 34 is communicated with a pump 58 for the pressure reduction valve via a pump port 39 for the pressure reduction valve. On the other hand, the outlet port 35 is, as shown in the left side of FIG. 3, is communicated with the pressure receiving chamber 30 via a port 41 formed in a sleeve 40 disposed in the blind bore 28, and a filter 42. On the other hand, when no filter is provided, the outlet port 35 is directly communicated with the pressure receiving chamber 30, as shown in the right side of FIG. 3. Furthermore, the spool bore 31 for the pressure reduction valve is communicated with the tank 57 via a tank port 43 for the pressure reduction valve of the valve body 20.

The tank port 43 for the pressure reduction valve and the pump port 39 for the pressure reduction valve are opened at front and back side faces 20*c* and 20*d* of the valve body 20.

As set forth above, by replacing the spring case 27 with one with only blind bore 28, a ordinary operating valve assembly of the type shifting the spool 22 by the external pilot pressurized fluid can be formed. Also, an operating valve assembly of the type shifting the spool 22 manually can be formed. Therefore, the valve body 20 can be used common in various kinds of operating valve assemblies.

On the other hand, the electromagnetic proportioning pressure reduction valve 37 is mounted on the left and right end faces 20*a* and 20*b*, and is disposed between the front side and back side faces 20*c* and 20*d* as shown in FIG. 4, the plane configuration becomes compact. Therefore, installation of the auxiliary valve can be facilitated. Also, even when the auxiliary valve is mounted, the required installation space can be maintained small.

It should be noted that while the pump port 39 for the pressure reduction valve and the tank port 43 for the pressure reduction valve are formed opening at the front and back side end faces of the valve body, it is also possible to form the pump port 39 for the pressure reduction valve and the tank port 43 for the pressure reduction valve opening at only the side end faces or at both of the front and back side end faces, respectively, to communicate the pump port 39 for the pressure reduction valve to the inlet port of the housing and to open the tank port for the pressure reduction valve to the spool bore for the pressure reduction valve of the housing.

Figure 6:
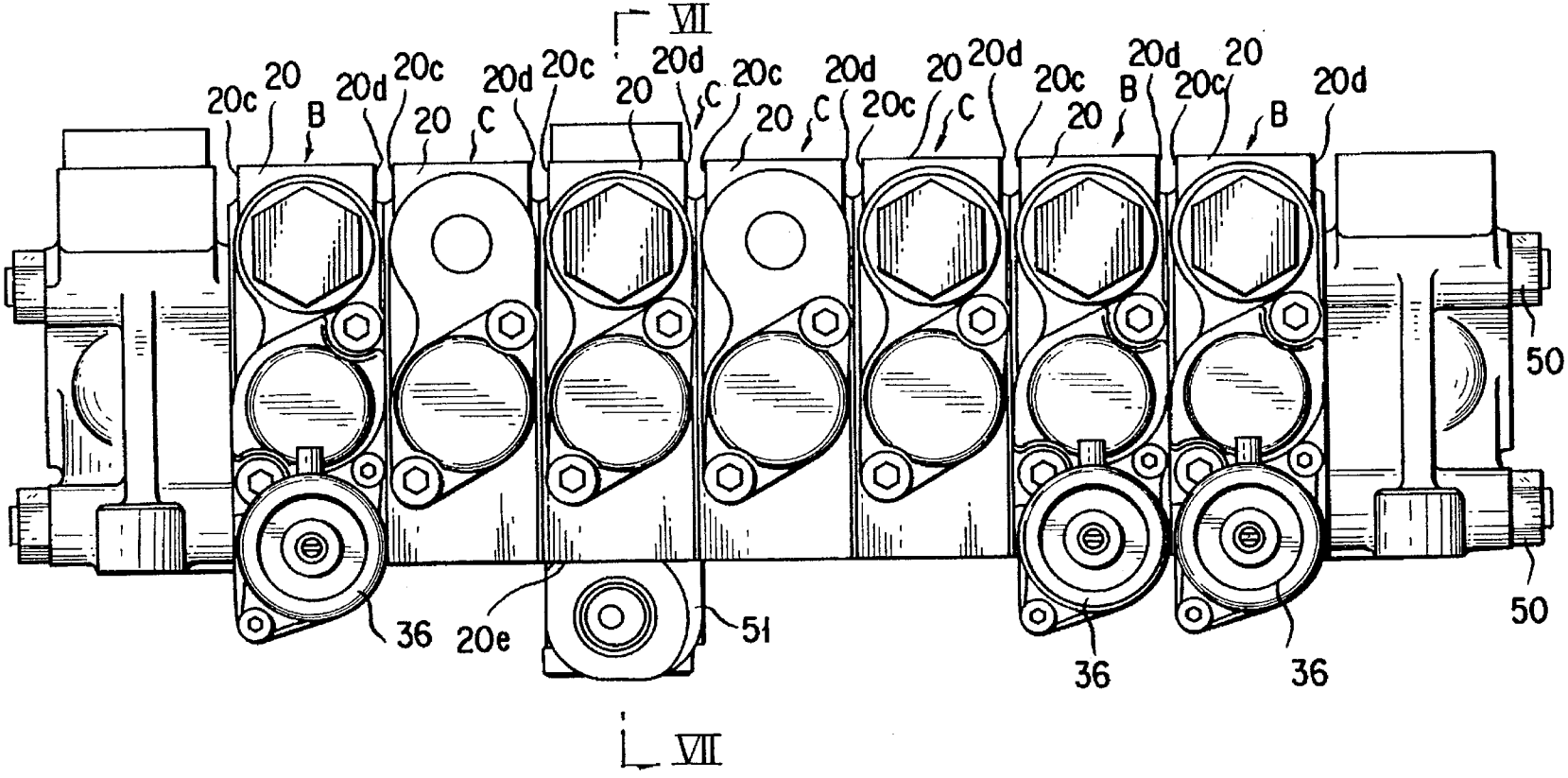
FIG. 6 is a side elevation of a multiple valve.

FIG. 6 is a side elevation of a multiple valve, in which a plurality of the operating valve assemblies B with the electromagnetic proportioning pressure reduction valves and a plurality of the ordinary operating valve assemblies C are coupled. The valve body 20 is common in each of the operating valve assemblies B and C. Also, the operating valve assemblies are coupled with stacking with mating the front and back side end faces 20*c* and 20*d* by an elongated bolt 50. With such construction, the pump ports 39 for the pressure reduction valves and the tank ports 43 for the pressure reduction valves are communicated through all of the valve bodies 20.

Figure 7:
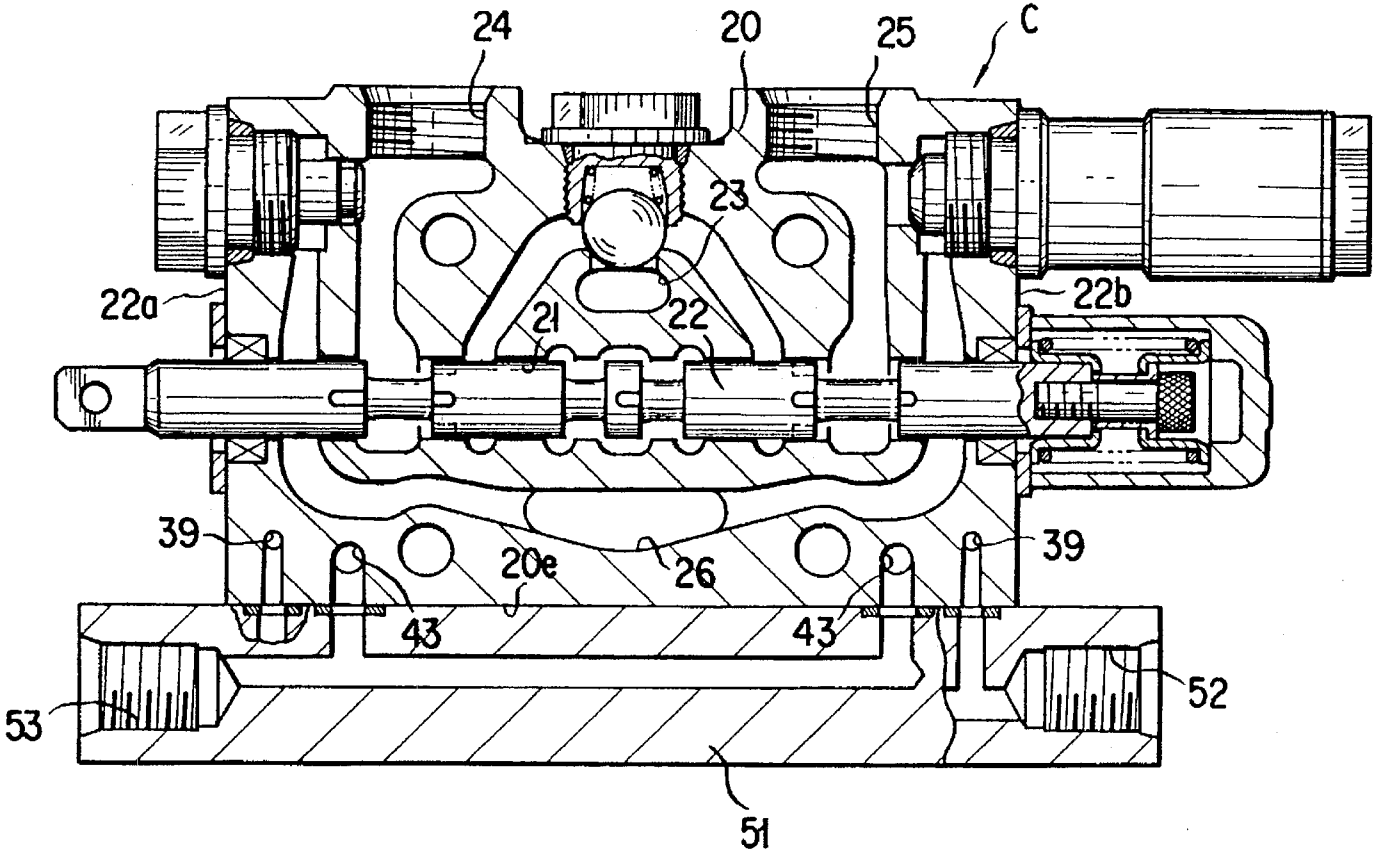
FIG. 7 is a section taken along line VII—VII of FIG. 6.

Then, a block 51 is mounted on the lower face 20*e* of the valve body 20 of the ordinary operating valve C. The block 51 is formed with an inlet port 52 for the pressure reduction valve and an outlet port 53 for the pressure reduction valve as shown in FIG. 7. The inlet port 52 for the pressure reduction valve is communicated with the pump port 39 for the pressure reduction valve and the outlet port 53 for the pressure reduction valves is communicated with the tank port 43 for the pressure reduction valve.

With the construction set forth above, in the multiple valve, the pressurized fluid for the pressure reduction valve can be supplied to respective electromagnetic proportioning pressure reduction valves B by mounting one block 51. Also, by differentiating orientation of respective ports of the block 51, the orientation of connection between the pressurized fluid source for the pressure reduction valve and the tank can be arbitrary changed.

It should be noted that while the foregoing embodiment is directed to the multiple valve, in which a plurality of the operating valves B with the electromagnetic proportioning pressure reduction valves and a plurality of the ordinary operating valves C, it is possible to form the multiple valve by connecting only a plurality of the operating valve B with the electromagnetic proportioning pressure reduction valves.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

INDUSTRIAL APPLICABILITY

As set forth above, the operating valve with the electromagnetic proportioning pressure reduction valve, according to the present invention, is quite useful as a device for controlling supply of the pressurized fluid to various kinds of hydraulic type actuators.

I claim:

1. An operating valve assembly with an electromagnetic proportioning pressure reduction valve, comprising:

an operating valve, including: a spool slidably disposed in a spool bore of the operating valve opening to an end face of a valve body, spring case including a case body having a blind bore and a housing having a spool bore for a pressure reduction valve mounted on said end face in a manner such that said spool bore of the operating valve and said blind bore are matched to each other, and a pressure receiving chamber defined between an interior wall of said blind bore of said spring case and an end portion of said spool; and an electromagnetic proportioning pressure reduction valve including: a spool for the pressure reduction valve disposed in said spool bore for the pressure reduction valve, and a solenoid for driving said spool for the pressure reduction valve mounted on said housing, an output port of said electromagnetic proportioning pressure reduction valve being in communication with said pressure receiving chamber;

a pump port for the pressure reduction valve and a tank port for the pressure reduction valve being formed opening to front and back side end faces of said valve body, said pump port for the pressure reduction valve being in communication with an inlet port of said housing, said tank port for the pressure reduction valve being open to said spool bore for the pressure reduction valve of said housing.

2. An operating valve assembly with an electromagnetic proportioning pressure reduction valve as set forth in claim 1, wherein a pair of left and right pressure receiving chambers are defined by mounting a first said spring case on a left end face of said valve body and a second said spring case on a right end face of said valve body, and two of said solenoid are mounted on respective said first and second spring cases for forming a pair of left and right electromagnetic proportioning pressure reduction valves, and the output port of each of said electromagnetic proportioning pressure reduction valves is communicated with each of said pressure receiving chambers.

3. An operating valve assembly with an electromagnetic proportioning pressure reduction valve as set forth in claim 2, wherein a pump port for the pressure reduction valve and a tank port for the pressure reduction valve are formed opening to lateral side end faces of said valve body.

4. An operating valve assembly with an electromagnetic proportioning pressure reduction valve as set forth in claim 2, wherein a pump port for the pressure reduction valve and a tank port for the pressure reduction valve are formed opening to lateral side end faces and front and back side end faces of said valve body, respectively.

5. An operating valve assembly with an electromagnetic proportioning pressure reduction valve as set forth in claim 1, wherein a pump port for the pressure reduction valve and a tank port for the pressure reduction valve are formed opening to lateral side end faces of said valve body.

6. An operating valve assembly with an electromagnetic proportioning pressure reduction valve as set forth in claim 1, wherein a pump port for the pressure reduction valve and a tank port for the pressure reduction valve are formed opening to lateral side end faces and front and back side end faces of said valve body, respectively.

7. A multiple valve assembly constructed by forming an operating valve assembly with an electromagnetic proportioning pressure reduction valve comprising:

an operating valve including: a spool slidably disposed in a spool bore opening to an end face of a valve body, a spring case including a case body having a blind bore and a housing having a spool bore for a pressure reduction valve mounted on said end face in a manner such that said spool bore and said blind bore are matched to each other, and a pressure receiving chamber defined between the interior wall of said blind bore of said spring case and the end portion of said spool; and an electromagnetic proportioning pressure reduction valve including: a spool for the pressure reduction valve disposed in said spool bore for the pressure reduction valve, and a solenoid for driving said spool for the pressure reduction valve mounted on said housing, an output port of said electromagnetic proportioning pressure reduction valve being in communication with said pressure receiving chamber; and a plurality of operating valve assemblies coupled with electromagnetic proportioning pressure reduction valves;

a pump port for the pressure reduction valve and a tank port for the pressure reduction valve being formed opening to front and back side end faces of said valve body, said pump port for the pressure reduction valve being in communication with an inlet port of said housing, said tank port for the pressure reduction valve being open to said spool bore for the pressure reduction valve of said housing;

respective pump ports for the pressure reduction valves and tank ports for the pressure reduction valves of a plurality of operating valve assemblies with electromagnetic proportioning pressure reduction valves being in communication with each other; and a block having an inlet port for the pressure reduction valve and an outlet port for the pressure reduction valve communicating with one of said pump ports for the pressure reduction valves and one of said tank ports for the pressure reduction valves of a plurality of said operating valve assemblies with electromagnetic proportioning pressure reduction valves, respectively.

8. A multiple valve assembly as set forth in claim 7, wherein pump ports and tank ports of a plurality of said operating valve assemblies with electromagnetic proportioning pressure reduction valves are respectively communicated.

9. A multiple valve assembly as set forth in claim 7, wherein a pair of left and right pressure receiving chambers are defined by mounting a first said spring case on a left end face of said valve body and a second said spring case on a right end face of said valve body, and two of said solenoid are mounted on respective said first and second spring cases for forming a pair of left and right electromagnetic proportioning pressure reduction valves, and the output port of each of said electromagnetic proportioning pressure reduction valves is communicated with each of said pressure receiving chambers.

10. A multiple valve assembly as set forth in claim 7, wherein two of said spring case are mounted, respectively, on left and right end faces of said valve body for defining a pair of left and right pressure receiving chambers, two of said solenoid are mounted on respective of said two spring cases to form a pair of left and right electromagnetic proportioning pressure reduction valves, said output port of each of said electromagnetic proportioning pressure reduction valves are communicated with respective pressure receiving chambers, respectively.

11. A multiple valve assembly constructed by forming an operating valve assembly with an electromagnetic proportioning pressure reduction valve comprising:

(a) an operating valve including: a spool slidably disposed in a spool bore opening to an end face of a valve body, a spring case including a case body having a blind bore and a housing having a spool bore for a pressure reduction valve mounted on said end face in a manner such that said spool bore and said blind bore are matched to each other, and a pressure receiving chamber defined between an interior wall of said blind bore of said spring case and an end portion of said spool; and (b) an electromagnetic proportioning pressure reduction valve including: a spool for the pressure reduction valve disposed in said spool bore for the pressure reduction valve, and a solenoid for driving said spool for the pressure reduction valve mounted on said housing, an output port of said electromagnetic proportioning pressure reduction valve being in communication with said pressure receiving chamber;

forming an operating valve assembly including: a spool slidably disposed in a spool bore opening to an end face of a valve body, a spring case including a case body having a blind bore and a housing having a spool bore for a pressure reduction valve mounted on said end face in a manner such that said spool bore and said blind bore are matched to each other, and a pressure receiving chamber defined between the interior wall of said blind bore of said spring case and the end portion of said spool;

coupling a plurality of operating valve assemblies with electromagnetic proportioning pressure reduction valves and a plurality of said operating valve assemblies;

a pump port for the pressure reduction valve and a tank port for the pressure reduction valve formed opening to front and back side end faces of said valve body, said pump port for the pressure reduction valve being in communication with an inlet port of said housing, said tank port for the pressure reduction valve being open to said spool bore for the pressure reduction valve of said housing;

respective pump ports for the pressure reduction valves and tank ports for the pressure reduction valves of a plurality of said operating valve assemblies with electromagnetic proportioning pressure reduction valves and a plurality of said operating valve assemblies being in communication with each other; and a block having an inlet port for the pressure reduction valve and an outlet port for the pressure reduction valve communicating with one of said pump ports for the pressure reduction valves and one of the tank ports for the pressure reduction valves of a plurality of said operating valve assemblies with electromagnetic proportioning pressure reduction valves, respectively.

12. A multiple valve assembly as set forth in claim 11, wherein pump ports and tank ports of a plurality of said operating valve assemblies with electromagnetic proportioning pressure reduction valves and said operating valve assemblies are communicated with each other.

13. A multiple assembly as set forth in claim 11, wherein two of said spring case are mounted, respectively, on left and right end faces of said valve body for defining a pair of left and right pressure receiving chamber, two of said solenoid are mounted on respective of said two spring cases to form a pair of left and right electromagnetic proportioning pressure reduction valves, said output port of each of said electromagnetic proportioning pressure reduction valves are communicated with respective pressure receiving chambers, respectively.

14. A multiple valve assembly as set forth in claim 11, wherein respective pump ports and tank ports of a plurality of said operating valve assemblies with an electromagnetic proportioning pressure reduction valves and said operating valve assemblies are communicated with each other.

15. A multiple valve assembly as set forth in claim 11, wherein two of said spring case are mounted, respectively, on left and right end faces of said valve body for defining a pair of left and right pressure receiving chambers, two of said solenoid are mounted on respective spring cases to form a pair of left and right electromagnetic proportioning pressure reduction valves, said output port of each of said electromagnetic proportioning pressure reduction valves are communicated with respective pressure receiving chambers, respectively.

* * * * *